US011588286B2

(12) United States Patent
Van Dommelen et al.

(10) Patent No.: US 11,588,286 B2
(45) Date of Patent: Feb. 21, 2023

(54) POWER DISTRIBUTION SYSTEM COMPRISING A TRACK TO WHICH ELECTRICAL COMPONENTS ARE CONNECTED

(71) Applicant: SIGNIFY HOLDING B.V., Eindhoven (NL)

(72) Inventors: Mark Josephus Lucien Maria Van Dommelen, Tilburg (NL); Frank Walterus Franciscus Marie Van Kempen, Echt (NL)

(73) Assignee: Signify Holding B.V., Eindhoven (NL)

( * ) Notice: Subject to any disclaimer, the term of this patent is extended or adjusted under 35 U.S.C. 154(b) by 0 days.

(21) Appl. No.: 17/055,538

(22) PCT Filed: May 15, 2019

(86) PCT No.: PCT/EP2019/062446
§ 371 (c)(1),
(2) Date: Nov. 21, 2019

(87) PCT Pub. No.: WO2019/219735
PCT Pub. Date: Nov. 21, 2019

(65) Prior Publication Data

US 2021/0111527 A1 Apr. 15, 2021

(30) Foreign Application Priority Data

May 16, 2018 (EP) ..... 18172568

(51) Int. Cl.
*H01R 25/14* (2006.01)
*H01R 13/64* (2006.01)
(Continued)

(52) U.S. Cl.
CPC ..... *H01R 25/145* (2013.01); *H01R 13/64* (2013.01); *H01R 24/28* (2013.01); *H01R 13/642* (2013.01);
(Continued)

(58) Field of Classification Search
CPC ..... H01R 25/142; H01R 9/26; H01R 9/2608; H01R 25/14; H01R 25/162; H01R 9/2658;
(Continued)

(56) References Cited

U.S. PATENT DOCUMENTS 5,306,165 A * 4/1994 Nadeau ..... H01R 25/14 439/115
6,033,239 A * 3/2000 Jaakkola ..... H01R 25/145 439/94
(Continued)

FOREIGN PATENT DOCUMENTS

CN 104348027 A 2/2015
CN 106099512 A 11/2016
(Continued)

*Primary Examiner* — Abdullah A Riyami
*Assistant Examiner* — Justin M Kratt

(57) ABSTRACT

The invention relates to a kit of parts comprising DC, low voltage system of an elongated track and a plug. The elongated track has a first and a second end and comprises an elongated slot formed by a central groove with at least one shielded lateral groove, both grooves lying in a plane P. Typically two electric conductors are accommodated in said at least one lateral groove. A connector portion of the plug having a connector cross section which matches with a cross section of the slot. Both said slot cross section and connector cross section are asymmetrical with respect to a plane Q extending over the length axis perpendicular to plane P, and at least one of the slot cross section and connector cross section is mirror symmetrical with respect to said plane P. The symmetric and asymmetric requirements posed on both
(Continued)

the cross section of the elongated track and the connector portion of the plug ensure that the connector portion only being insertable into the first end in the axial direction and, after a rotation of 180° over its connector axis, only being insertable in the axial direction into the second end of said track, with maintenance of the correct polarity The invention further relates to a plug suitable for use in the kit of parts according to the invention.

12 Claims, 6 Drawing Sheets

(51) Int. Cl.

| | |
|---|---|
| ***H01R 24/28*** | (2011.01) |
| *H01R 103/00* | (2006.01) |
| *H01R 107/00* | (2006.01) |
| *H01R 33/06* | (2006.01) |
| *H01R 25/16* | (2006.01) |
| *H01R 13/642* | (2006.01) |

(52) U.S. Cl.
CPC ..... *H01R 25/162* (2013.01); *H01R 33/06* (2013.01); *H01R 2103/00* (2013.01); *H01R 2107/00* (2013.01)

(58) Field of Classification Search
CPC .... H01R 25/16; H01R 25/161; H01R 25/168; H01R 25/145; H01R 24/28; H01R 13/64; H01R 2103/00; H01R 2107/00
USPC ..... 439/94, 121, 532, 716
See application file for complete search history.

(56) References Cited

U.S. PATENT DOCUMENTS

| | | | | |
|---|---|---|---|---|
| 6,394,626 | B1 | 5/2002 | McColloch | |
| 7,819,676 | B1 * | 10/2010 | Cardoso ..... | H02G 3/0431 439/115 |
| 2010/0130055 | A1 | 5/2010 | Liang et al. | |
| 2013/0143423 | A1 | 6/2013 | Luksic et al. | |
| 2013/0323950 | A1 | 12/2013 | Gingrich, III et al. | |
| 2015/0092449 | A1 | 4/2015 | Demuynck et al. | |
| 2016/0316939 | A1 | 11/2016 | Kraiss et al. | |
| 2018/0062333 | A1 | 3/2018 | Lewis et al. | |
| 2018/0224104 | A1 * | 8/2018 | Bernard ..... | F21S 8/04 |

FOREIGN PATENT DOCUMENTS

| | | | |
|---|---|---|---|
| GB | 2149230 | A | 6/1985 |
| KR | 100424781 | B1 | 3/2004 |

* cited by examiner

POWER DISTRIBUTION SYSTEM COMPRISING A TRACK TO WHICH ELECTRICAL COMPONENTS ARE CONNECTED

CROSS-REFERENCE TO PRIOR APPLICATIONS

This application is the U.S. National Phase application under 35 U.S.C. § 371 of International Application No. PCT/EP2019/062446, filed on May 15, 2019, which claims the benefit of European Patent Application No. 18172568.0, filed on May 16, 2018. These applications are hereby incorporated by reference herein.

FIELD OF THE INVENTION

The invention relates to a kit of parts comprising an elongated track and a plug. The invention further relates to a plug of said kit of parts.

BACKGROUND OF THE INVENTION

In particular such a kit of parts is related to an electrical power track system for lighting purposes, such as a mini-track system being of direct current (DC) thus having a specific polarity, and being of low voltage, e.g. 24 Volt or 12 Volt. These tracks find wide application for distribution of power, for example in domestic appliances, such as a room of a house, or in professional environments such as offices and/or shop windows. Via plugs, the track can be connected to power means for providing power to a single module or a plurality of energy consuming modules mountable on said track. Often the provision of a plurality of plugs is done to provide all of the plurality of mounted modules with power. However, this involves both the risk of a power overload of the track with subsequent risk of overheating and early failure, and involves the risk of connecting plugs with reversed polarity for said DC tracks. GB2149230A discloses a mains voltage electric power distribution system comprising a track and a plug in which the abovementioned problems of overload and connecting with reversed polarity are counteracted. When transformed to low voltage systems, this known power distribution system has yet the disadvantage that only one plug can be provided which often is insufficient to provide all of the plurality of mounted modules with enough power.

SUMMARY OF THE INVENTION

It is an object of the invention to provide, as a power distribution system, a kit of parts comprising a track and plug of the type as described in the opening paragraph and in which at least one of the disadvantages is counteracted. Thereto the kit of parts comprises an elongated track and a plug:

the elongated track extending along a length axis in an axial direction, having a first and a second end and comprising an elongated slot formed by a central groove with at least one shielded lateral groove, said slot having a slot cross section and an open side opposite a bottom surface, said central groove and lateral groove extend next to each other in a plane P, at least two electric conductors are accommodated in said at least one lateral groove, said slot, open side, central groove, at least one lateral groove and electric conductors extend in axial direction essentially from the first end to the second end, a connector portion of the plug extending along a connector axis, having a first and a second, oppositely arranged main surface, and having a connector cross section which matches with the slot cross section, wherein both said slot cross section and connector cross section are asymmetrical with respect to a plane Q extending over the length axis perpendicular to plane P, and at least the slot cross section is mirror symmetrical with respect to said plane P, and the slot comprises at least one off-center located profiled structure extending in axial direction over essentially the whole length over the bottom surface of the slot, and each main surface has a corresponding inversed profiled structure provided on the first and second main surface in mutually mirrored position with respect to plane P.

The slot cross section defines a key function for connectable elements to ensure correct polarity for both plugs and for modules such as lighting modules such as lamp units and/or sensors etc. The symmetric and asymmetric requirements posed on both the cross section of the elongated track and the connector portion of the plug ensure that the connector portion only being insertable into the first end in the axial direction. To switch the plug from the first end to the second end, it needs to be inserted from the opposite direction into the slot of the elongated track and thereto needs to be rotated over 180° over a normal axis perpendicular to plane P. If the elongated track and the connector portion of the plug would be symmetrical with respect to plane Q, the plug could be inserted with the wrong polarization into the slot. Thereto, both the track and the connector portion are asymmetrical with respect to plane Q, typically parts of the connector portion that match with the profile of the slot and are used for blocking or allowing insertion of the connector portion in the slot are symmetrical with respect to plane P so that after a rotation of 180° over its connector axis only being insertable in the axial direction into the second end of said track with the correct polarity. Hence, no mirror plugs are needed for connection of a plugs to both ends of the track, but this is thus attained by a single shape of the plug. Furthermore, the dimensions of the plug, and/or locations of electrical contacts on the plug with respect to the locations of the electrical conductors in the elongated track counteract that the plug can be inserted via the openside into the elongated track and electrically connected to the electric conductors of the elongated track, for example in that the connector portion is too large to be inserted into the slot via the open side of the slot.

It is further noted that the mirror symmetry need not to be exact for the whole connector portion, but only for critical parts thereof, i.e. it only needs to be sufficient to block the possibility to connect the plugs and modules in reverse polarity and yet enable insertion of the connector portion into either end of the track with the correct polarity. Furthermore asymmetric patterns or a mount feature may be provided on one or both of the main surfaces of the connector portion, for example for easy mounting of add-ons like an adaptable driver, sensor, and antenna for sending receiving (internet, communication, radio, Global Positioning System GPS)) signals or a light emitting diode (LED) light source or indicator, rendering the connector portion to be asymmetric with respect to plane P. Typically, but not necessarily, two electric conductors are used in the DC, low voltage elongated track according to the invention.

Often in known systems the plug comprises both a male and a female connector portion which enables multiple stacking of plugs onto each other and hence that multiple plugs are connectable to the elongated track via a single end of the elongated track, involving the subsequent risk too much power is connected to the elongated track and overload of the elongated track. To counteract that too much power is connectable to the elongated track via the plugs, the kit of parts may have the feature that the plug comprises only one connector portion.

The kit of parts may have the feature that the at least one shielded lateral groove has a lip extending over the lateral groove, said at least two electric current conductors being either embedded in said lip or embedded in a portion of said bottom surface opposite said lip, said connector having on each main surface one pair of electrical contacts which are mutually arranged in mirror symmetry with respect to plane P. In particular it is thus attained that electrical contact is made with the electric conductors in the lateral groove upon insertion into either end, but that in inserted position of the plug in the elongated track, the non-used pair of electrical contacts of the plug are shielded by the connector portion itself from unintentional touching by users.

As an alternative configuration to the at least two electric conductors being provided in a single lateral groove, the kit of parts may have the feature that the at least one shielded groove comprises a shielded lateral groove on either side of the central groove, each groove accommodating a respective one of the at least two electric current conductors. The grooves are then located relatively remote from each other which reduces the risk on short circuiting.

The kit of parts may have the feature that the connector portion comprises electrical contacts located at opposite lateral sides for electrical contacting in inserted portion to a respective electric conductor provided in a respective side walls of each lateral groove. Thus the number of electrical contacts on the plug can be limited to only one pair rendering it relatively cheap and of simple construction.

The kit of parts thus has the feature that the slot comprises at least one off-center located profiled structure extending in axial direction over essentially the whole length over the bottom surface of the slot, and each main surface has a corresponding inversed profiled structure provided on the first and second main surface in mutually mirrored position with respect to plane P. Such profiled structure is a simple and convenient means for providing the slot and connector portion with the required asymmetric for ensuring mounting of the plugs and/or modules with the correct polarity. Typically the profiled structure is at least one of a protruding rib, protruding step, indented slit and recessed step. Such profiled structures are relatively easy and cheaply manufacturable, for example via an extrusion process. Preferably, is symmetrical with respect to plane P for features of the connector cross section which are critical for a mutual match with the inverse features of the track.

The kit of parts may have the feature that the connector portion is located on the plug such that a dimension Dp between the center of the connector portion to either main face of the plug in a height direction perpendicular to plane P is at most a track dimension Dt, said track dimension Dt being a distance in said height direction defined by the center of the slot and a carrier surface of the track.

It is thus enabled to mount track without spacing to a ceiling, shelf etc., for example via a double sided adhesive tape or Velcro provided on a carrier surface of the track, and yet rotate the plug upside-down for insertion of the plug into another end of the elongated track. It is furthermore advantageous for this purpose that the kit of parts may have the feature that the connector portion has the largest dimension of the plug in said height direction to further simplify mounting.

The kit of parts may have the feature that it further comprises at least one module, such as a lighting module, for example a lamp, a LED module, motion sensor, occupancy sensor, infrared (IR)-sensor, smoke detector, dimmer, GPS, data-communication module, which is insertable with an insertion portion in a radial direction into the elongated slot via the open side of the slot. Different types of modules might be mounted on the elongated track and be used simultaneously. Said modules find wide application and are suitable for providing lighting, lighting control like energy saving and dedicated lighting, internet services, occupancy monitoring and provide means for enhancing safety.

The kit of parts may have the feature that the open side is narrowed by two lips, each lip extending over a respective lateral groove. Thus unintentional contacting by a user of the electrical conductors provided in the elongated track is counteracted, for example in that the open side is rendered to be so small by said lips that an adult cannot insert a finger through the open side into the slot.

The kit of parts may have the feature that the plug comprises a driver which is a convention means for controlling power to the elongated track.

The kit of parts may have the feature that it comprises a further plug. Said further plug is the provided in the remaining open end and can be used to provide more power to the elongated track in case the number of mounted modules on the track is too high to be powered via a single plug. However, because the number of mountable plugs which provided power to the track is limited to maximally two, an overload of the elongated track is counteracted.

The invention further relates to a plug suitable for use in the kit of parts according to the invention, the plug having a connector portion extending along a connector axis and has two main surfaces on either side of a plane P, at least one of the main surfaces is provided with a mount feature. The plug may have the feature that it comprises at least one of a driver, a LED, an antenna, and a sensor.

BRIEF DESCRIPTION OF THE DRAWINGS

The invention will now be further elucidated by means of the schematic drawings describing various embodiments which are not intended to limit but rather to exemplify the versatility of the invention. In the drawings.

DETAILED DESCRIPTION OF EMBODIMENTS

Figure 1:
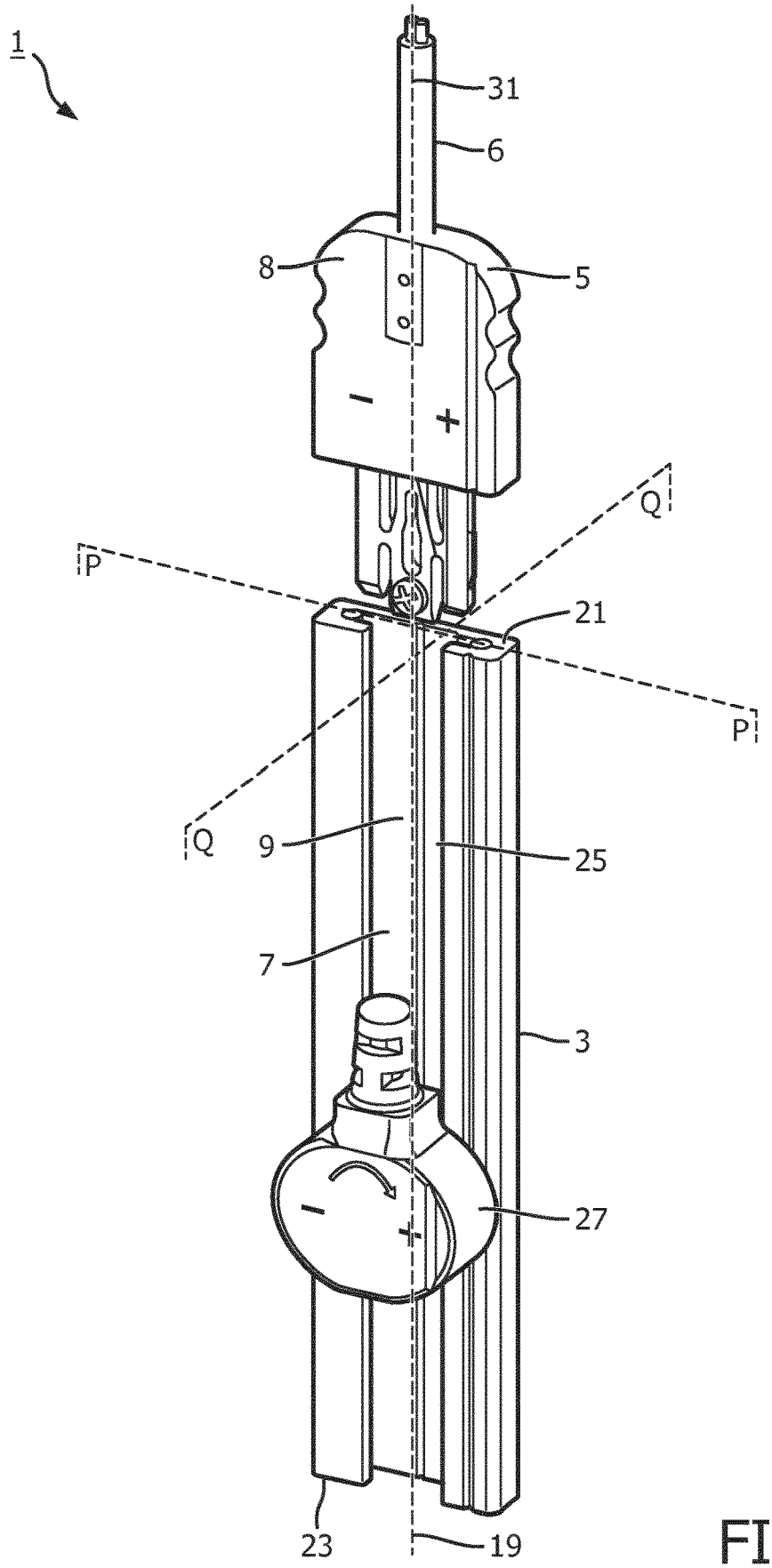
FIG. 1 shows a perspective general view of first embodiment of a kit of parts according to the invention.
Figure 2:
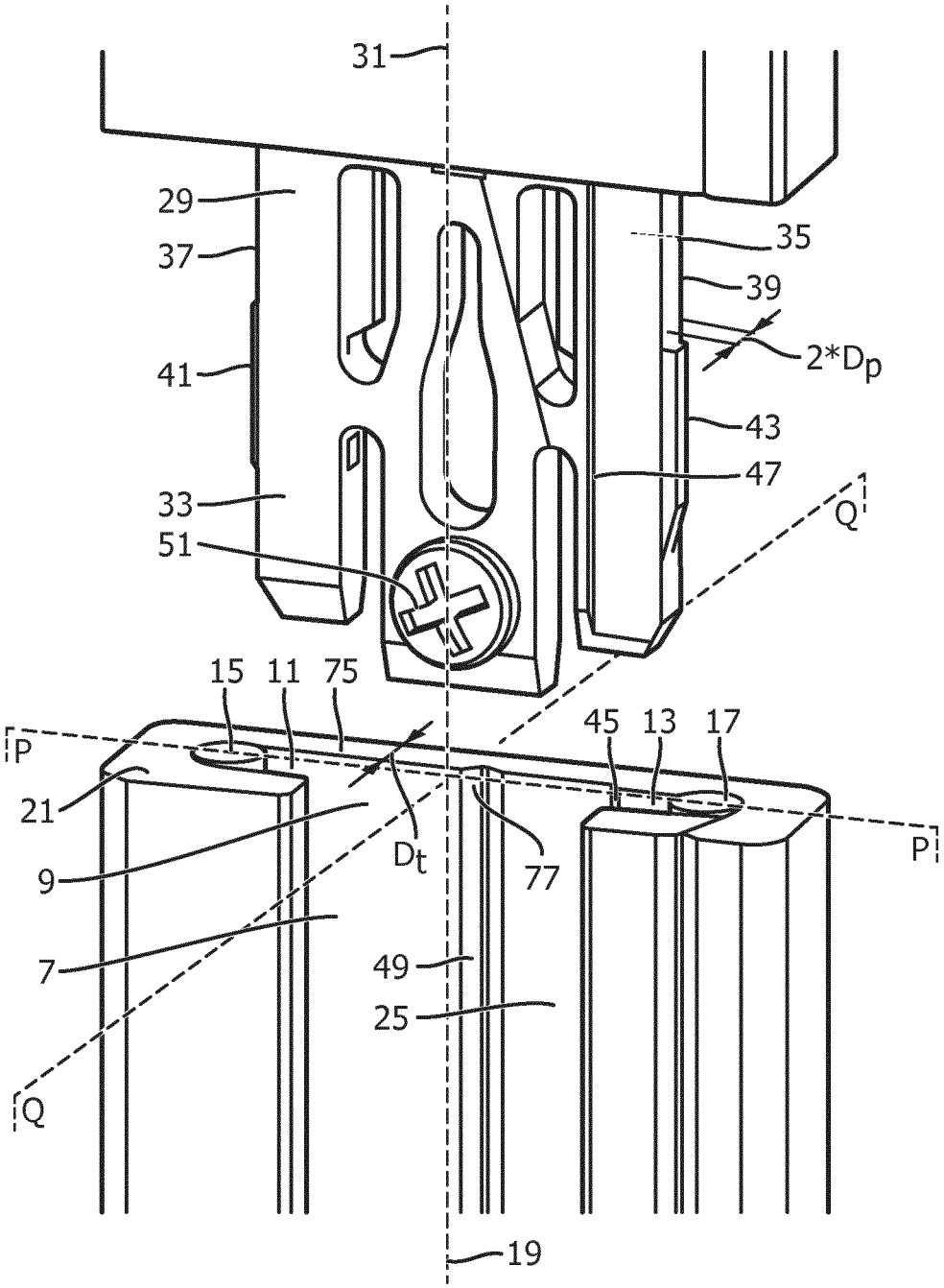
FIG. 2 shows a detailed perspective view of the kit of parts of FIG. 1.

FIG. 1 shows a perspective general view of first embodiment of DC, low voltage power system comprising a kit of parts 1 according to the invention, of which FIG. 2 shows a local perspective more detailed view. The kit of parts comprises an elongated track 3 and at least one plug 5 connected via a main body 8 and an electric cable 6 of the plug to an external/remote power source (not shown). The track extends along a length axis 19 and comprises an elongated slot 7 having an open side 25 and is formed by a central groove 9 and a lateral groove 11, 13 on either side of the central groove. Each lateral groove accommodating a respective electric current conductor 15,17. The elongated track has a first end 21 and a second end 23, the slot, the open side, the grooves, and the current conductors all extend from the first end to the second end. Via the open side a single module 27 is mounted on the elongated track. The module in the FIG. 1 is an LED module, but this can alternatively or additionally, in case more modules are mounted on the elongated track, be one or more of, for example, a lamp, an electronic dimmer, motion sensor, occupancy sensor, IR-sensor, smoke detector, dimmer, GPS, and data-communication module. The modules can be mounted in the slot on any location on the elongated track. The polarity of the parts of the power system is indicated on both the module and the plug. The plug 5 is to be inserted into the first end 21 of the elongated track and thereto comprises a connector portion 29 extending along a connector axis 31, which in inserted portion in the slot coincides with the length axis 19. The plug is also insertable with the correct polarity into the second end of the track, however, a second plug (not shown) additionally be inserted into one of the first and second end. The connector portion has a first 33 and a second 35 mutually oppositely arranged main surfaces which are bounded by side surfaces 37, 39 each provided with a respective lateral contact 41, 43 for electrically contacting a respective electric current conductor of the elongated track 3.

FIG. 2 further shows a cross section of the elongated track 3 and of the slot 7. It is clearly visible that the slot has profiled structure 45 rendering it to be both asymmetrical with respect to a plane P in which the central groove and the lateral grooves extend, and to be asymmetrical with respect to a plane Q which extends along the length axis perpendicular to plane P. In FIG. 2 the profiled structure is protruding step provided in one lateral groove. The plug 5 has connector cross section matching in shape with the slot cross section of the slot in that the connector portion is provided with an inversed profiled structure 47 to the profiled structure of the slot, i.e. a recessed portion in both main surfaces 33 and 35. The profiled structure extends from the first end to the second end of the elongated track. The inversed profiled structure is provided in mirror configuration with respect to plane P on both main surfaces of the connector portion rendering the connector portion to be symmetrical with respect to plane P. It is further noticed that the connector cross section of the connector portion is asymmetrical with respect to plane Q. The keying function of the combination of slot cross section and connector cross section thus obtained ensures that the connector can switch between the first end and the second end with maintenance of the correct polarity. It is further shown that the central groove of the slot is provided with a further profiled structure 49, in the Figure an elongated recess, which can be used for further keying function but which alternatively or additionally can be used for a firm fixation of the plug in the slot by a screw 51.

Further to FIG. 2 it is shown that the connector portion has a thickness between the two main surfaces 33 and 35 of 2*Dp and that the dimension between the center of the connector portion to either main face here is Dp, which is less than the dimension Dt between the center 77 of the slot and a carrier surface 75 of the track in the height direction perpendicular to plane P.

Figure 3A:
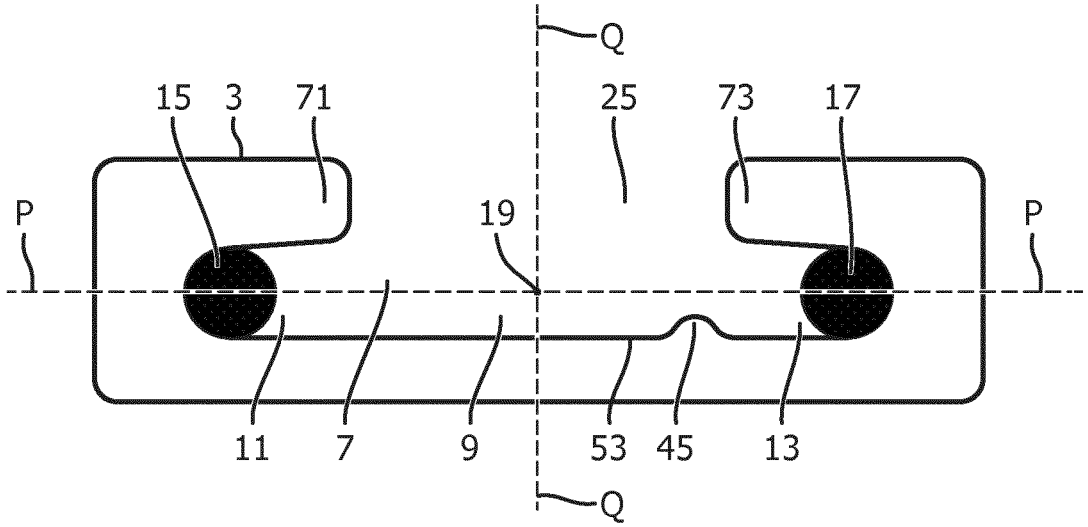
FIGS. 3A-E show a cross sectional view of parts of a second embodiment of the kit of parts according to the invention.

FIGS. 3A-E shows a cross sectional view of parts of a second embodiment of the kit of parts according to the invention. FIG. 3A shows a slot cross section of the elongated track 3 in which the central groove 9 is provided with a protruding ridge as the profiled structure 45 extending along the length axis 19 and in an asymmetrical location with respect to plane Q over a bottom surface 53 of the slot 7 opposite the open side 25 of the slot. On either side of the central groove a lateral groove 11, 13 accommodating a respective electric current conductor 15, 17, is provided. Respective lips 71, 73 extend over a respective lateral groove narrowing the size of the open side and reducing the risk on unintentional touching the electrical conductors by users. The slot cross section is asymmetrical with respect to both plane P and plane Q.

Figure 3B:
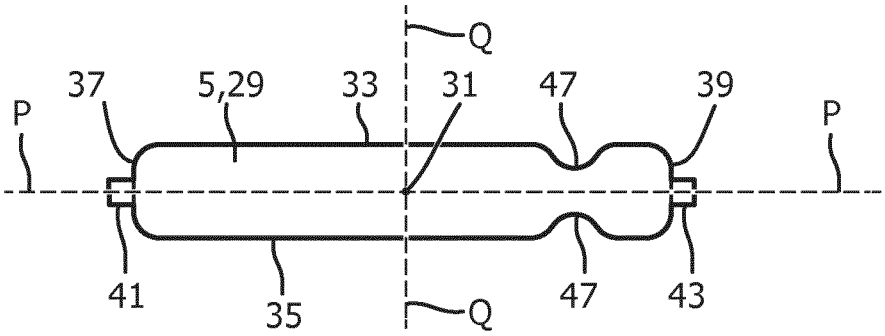

FIG. 3B shows the connector cross section of the connector portion 29 of the plug 5, matching in shape with the slot cross section shown in FIG. 3A, i.e. in that the first 33 and second main surface 35 of the connector portion each is provided with an inversed profiled structure 47, i.e. an indentation extending along the connector axis 31. The indentations are located in mirrored position with respect to plane P. The connector cross section is asymmetrical with respect to plane Q. Each side face 37, 39 of the connector portion is provided with a respective lateral electric contact 41, 43.

Figure 3C:
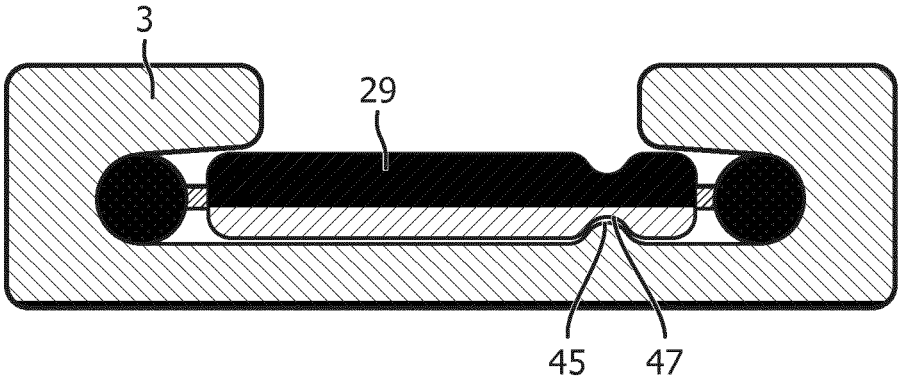

FIG. 3C shows the connector portion 29 of FIG. 3B in inserted position in an end of the elongated track 3 of FIG. 3A, clearly showing the matching shape of the profiled structure 45 the slot cross section with the inversed profiled structure 47 of the connector cross section. Also shown is that each lateral contact of the connector portion contacts a respective electric current conductor embedded in a respective lateral groove of the slot.

Figure 3D:
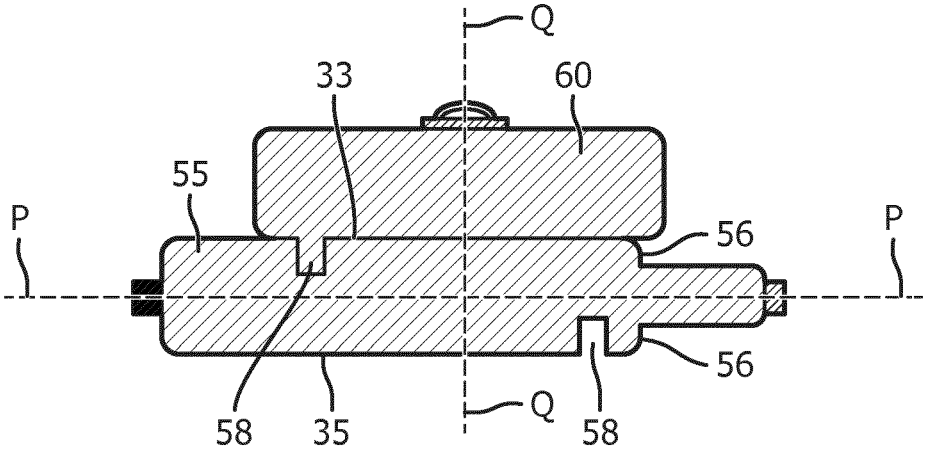
Figure 3E:
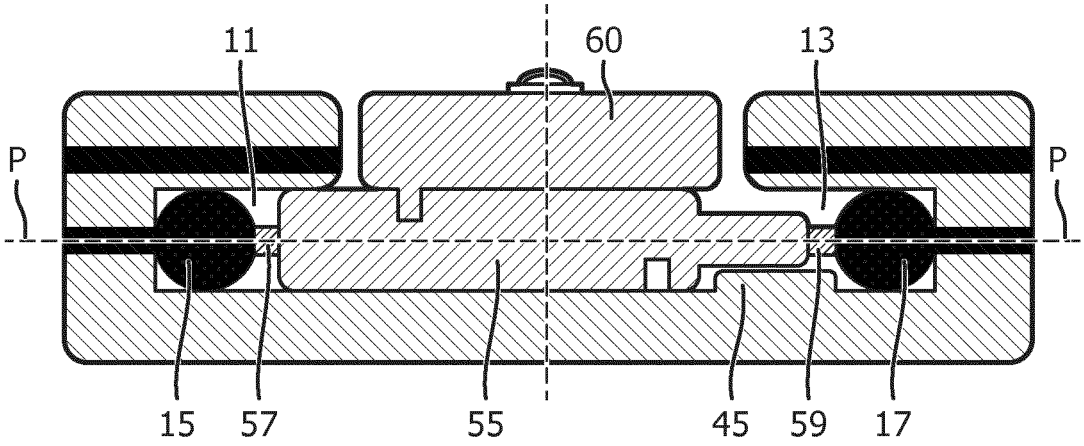

FIGS. 3D-E shows a cross section of an insertion portion 55 of a module mountable on the elongated track of FIG. 3A. Thereto the insertable portion has a profile 56 of its cross section matching with the profile 45 in the cross section of the slot of FIG. 3A, i.e. it has an indented step. To ensure mounting with the correct polarity said cross section of the insertable portion comprises symmetrically arranged critical parts, for example profile 56, and for non-critical parts the insertion portion 55 is asymmetric with respect to both plane P and plane Q, for example a mount feature 58 provided on both the main surfaces 33,35. In FIG. 3D the insertion portion 55 is provided with an indicator LED as an add-on 60. FIG. 3E shows the insertion portion 55 with mounted add-on 60 of the module in mounted position on the track 3 of FIG. 3A. FIG. 3E also shows that the insertion portion with its lateral electrically conducting tongues 57, 59 contacts a respective electric current conductor 15, 17 embedded in a respective lateral groove 11, 13 of the slot. These tongues assist in securing the module onto the track and in preventing it from falling down, for example when the elongated track is mounted with its carrier surface to a ceiling.

Figure 3F:
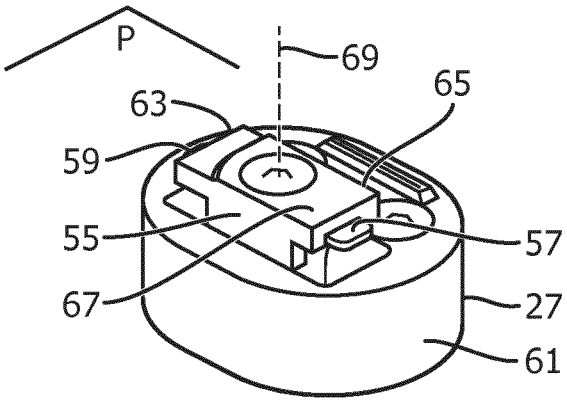
FIG. 3F shows a perspective bottom view of a module of the second embodiment of the kit of parts according to the invention.

FIG. 3F shows a perspective bottom view of a module 27 of the second embodiment of the kit of parts according to the invention. The module comprises a main part 61, for example comprising a specific feature of the module, such as an LED, dimmer, sensor, GPS etc., and an insertion portion 55. The insertion portion 55 has an elongated, rectangular shape with a short side 63 and a long side 65. Mounting of the module onto the elongated track occurs as follows. The insertion portion is inserted via the open side of the slot into the slot with its long side parallel to the length axis of the elongated track and with its bottom face 67 facing towards the bottom of the slot. Subsequently the module is rotated 90° over an insertion axis 69 perpendicular to plane P, such that electrically conducting tongues 57, 59 of the module establish electrical contact with the electric current conductors of the track. The profile of the cross section of the insertion portion matches with the profiled structure of the slot, and enables and ensures that the module is mounted with the correct polarity onto the track.

Figure 4A:
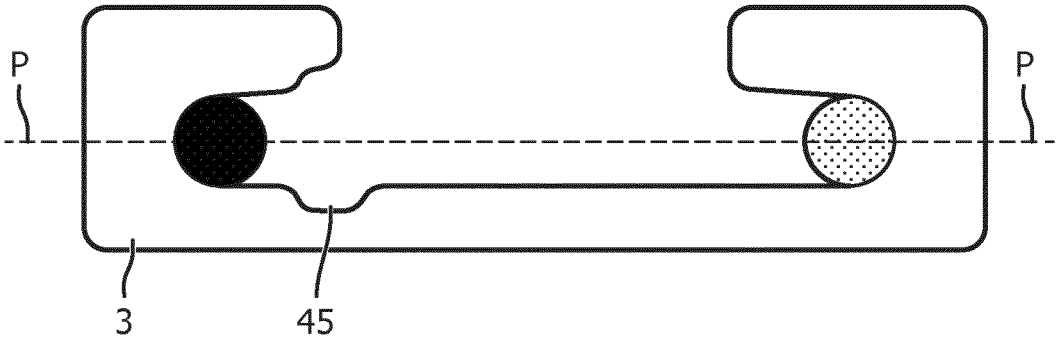
FIGS. 4A-C show a cross sectional view of parts of a third embodiment of the kit of parts according to the invention.
Figure 4B:
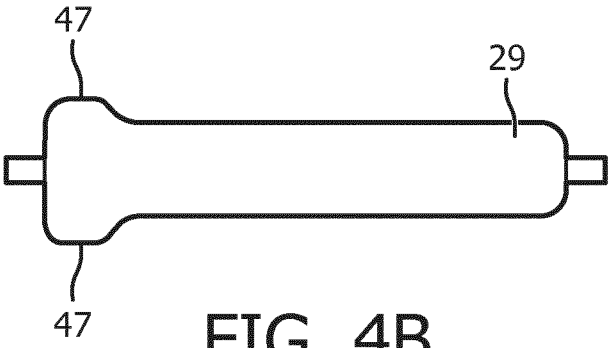
Figure 4C:
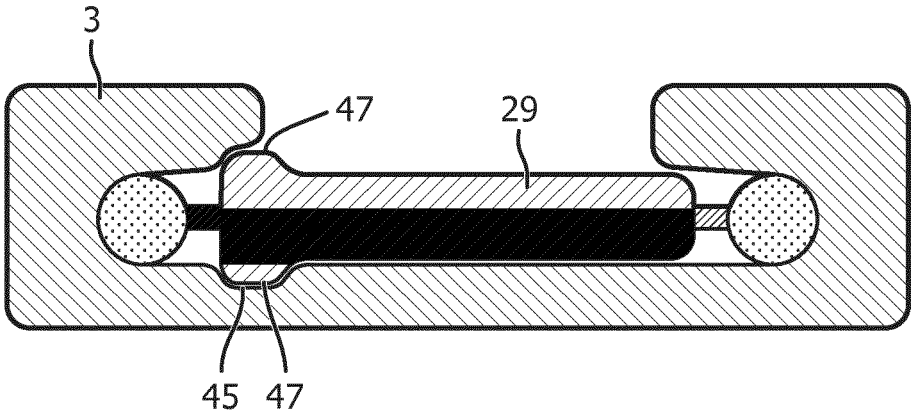
Figure 5A:
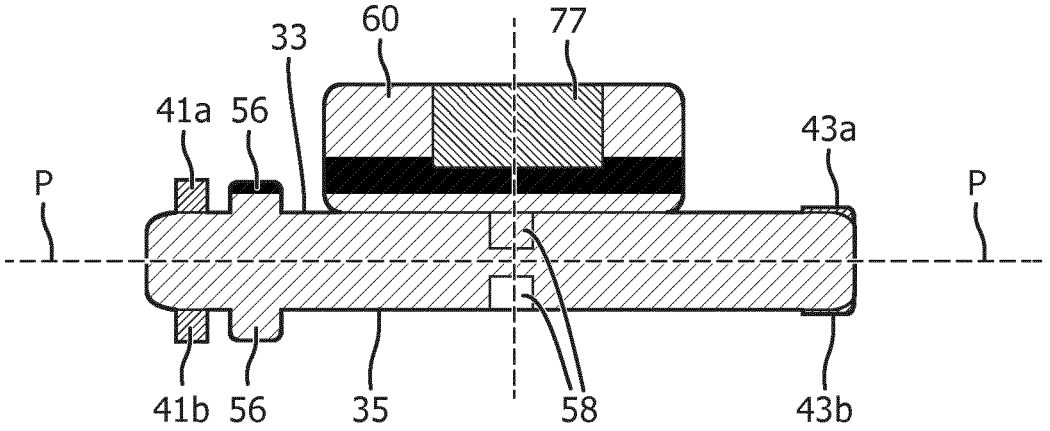
FIGS. 5A-B show a cross sectional view of an elongated track of a fourth embodiment of the kit of parts according to the invention.
Figure 5B:
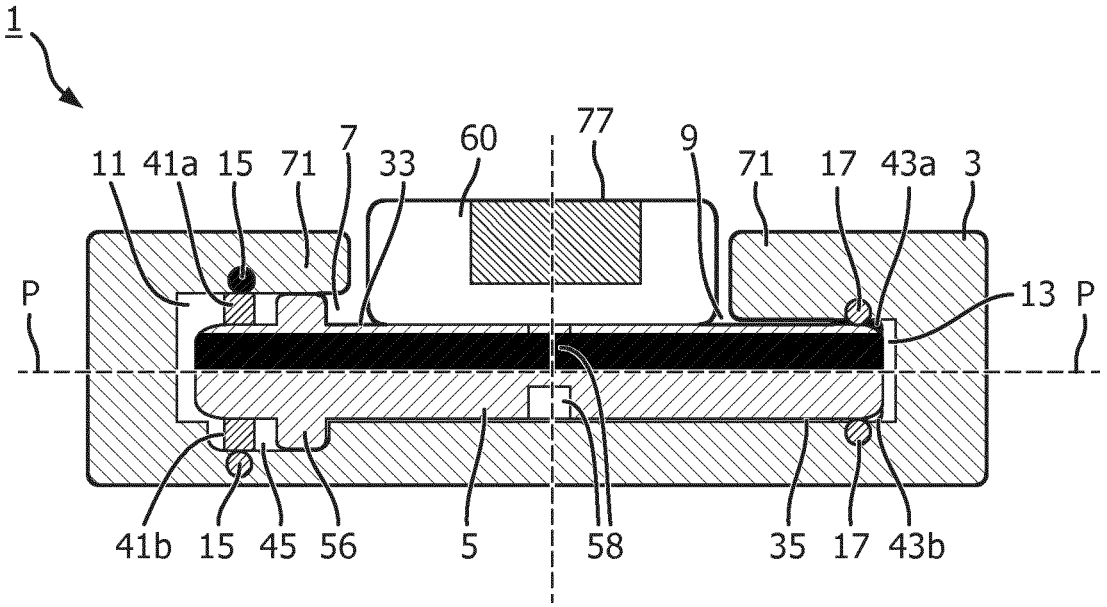

FIGS. 4A-C shows a cross sectional view of parts of a third embodiment of the kit of parts according to the invention. The FIGS. 4A-C are analogous to the FIGS. 3A-C, yet with the profiled structure 45, the inversed profiled structure 47 and the profile of the insertion portion essentially being reversed, i.e. the protruding ridge in the slot cross section of the track 3 as shown in FIG. 3A is now an elongated indentation, the indentation in the connector portion 29 now is a protrusion and the indented step of the profile 56 now is a protruding step. All further aspects are similar and fulfill the demands on asymmetry and symmetry with respect to planes P and Q as posed on both the slot of the track and the connector portion of the plug. Yet note that the slot cross section is asymmetric and the connector cross section is mirror symmetric with respect to plane P. Specifically FIGS. 5A and 5B show a cross sectional view of an elongated track 3 and inserted plug 5 of a fourth embodiment of the kit of parts 1 according to the invention. In this embodiment the elongated track has a slot 7 formed by a central groove 9 and lateral grooves 11, 13. The plug and track each have respective profile 56, 45 that mutually match. Said lateral grooves are shielded by lips 71 extending over the lateral grooves, in said lip two pairs of electric current conductors 15, 17 are embedded and which essentially lie symmetrically with respect to plane P. The connector portion has two pairs of electrical contacts 41*a*,43*a* and 41*b*,43*b*, one pair on each main surface 33, 35 of the connector portion. The contact pairs are in mutual mirror position with respect to plane P. The main body of the plug is provided via a mount feature 58 provided on both the main surfaces 33,35 with an add-on 60, in the figure a driver 77.

In all the figures, the slot, the open side, the current conductors, the lips and the profiled structure extend in axial direction essentially over the whole length from the first end to the second end of the track, optionally interrupted by bridges over the open side to render the elongated track more robust.

The invention claimed is:

1. Kit of parts for a lighting system including an elongated track and a plug for connecting the elongated track to a power means, the kit of parts comprising:

the elongated track extending along a length axis in an axial direction, having a first and a second end and comprising an elongated slot formed by a central groove with at least one shielded lateral groove, said slot having a slot cross section and an open side opposite a bottom surface, wherein the slot includes a profiled structure to enable a keying function or for firm fixation of the plug in the slot, said central groove and lateral groove extend next to each other in a plane P, at least two electric conductors are accommodated in said at least one lateral groove, said slot, open side, central groove, at least one lateral groove and electric conductors extend in an axial direction essentially from the first end to the second end, a connector portion of the plug extending along a connector axis, having a first and a second oppositely arranged main surface, and having a connector cross section which matches with the slot cross section, wherein both said slot cross section and connector cross section are asymmetrical with respect to a plane Q extending over the length axis perpendicular to plane P, and at least the slot cross section is mirror asymmetrical with respect to said plane P, and the slot comprises at least one off-center located profiled structure extending in axial direction over essentially the whole length over the bottom surface of the slot, and each main surface has a corresponding inversed profiled structure provided on the first and second main surface in mutually mirrored position with respect to plane P, and wherein the connector cross section of the plug is symmetrical with respect to plane P for features of the connector cross section which are critical for a mutual match with the inverse features of the track, including the electric conductors, and for rendering the connector portion insertable in both the first and second end of the elongated track with the correct polarity.

2. Kit of parts as claimed in claim 1, wherein the plug comprises only one connector portion.

3. Kit of parts as claimed in claim 1, wherein the at least one shielded groove comprises a shielded lateral groove on either side of the central groove, each groove accommodating a respective one of the at least two electric current conductors.

4. Kit of parts as claimed in claim 3, wherein the connector portion comprises electrical contacts located at opposite lateral sides.

5. Kit of parts as claimed in claim 1, wherein the profiled structure is at least one of a protruding rib, protruding step, indented slit and recessed step.

6. Kit of parts as claimed in claim 1, wherein the connector portion is located on the plug such that a dimension Dp between the center of the connector portion to either main face of the plug in a height direction perpendicular to plane P is at most a track dimension Dt, said track dimension Dt being a distance in said height direction defined by the center of the slot and a carrier surface of the track.

7. Kit of parts as claimed in claim 5, wherein the connector portion has the largest dimension of the plug in a height direction.

8. Kit of parts as claimed in claim 1, further comprising at least one module which is insertable with an insertion portion in a radial direction into the elongated slot via the open side.

9. Kit of parts as claimed in claim 1, wherein the open side is narrowed by two lips, each lip extending over a respective lateral groove.

10. Kit of parts as claimed in claim 1 comprising a further plug.

11. Plug suitable for use in the kit of parts according to claim 1, the plug having a connector portion extending along a connector axis and has two main surfaces on either side of a plane P, at least one of the main surfaces is provided with a mount feature for easy mounting of add-ons and wherein the add-ons extend out of the open side of the slot, wherein the connector cross section is symmetrical with respect to plane P for features of the connector cross section which are critical for a mutual match with inverse features of a track.

12. Plug as claimed in claim 11, wherein the plug comprises as the add-on at least one of the driver, a Light Emitting Diode (LED), an antenna, and a sensor.

* * * * *